US007609230B2

(12) United States Patent
Dispoto et al.

(10) Patent No.: US 7,609,230 B2
(45) Date of Patent: Oct. 27, 2009

(54) DISPLAY METHOD AND SYSTEM USING TRANSMISSIVE AND EMISSIVE COMPONENTS

(75) Inventors: Gary Dispoto, Mountain View, CA (US); Sabine Susstrunk, Palo Alto, CA (US); Robert W. G. Hunt, Salisbury (GB)

(73) Assignee: Hewlett-Packard Development Company, L.P., Houston, TX (US)

( * ) Notice: Subject to any disclaimer, the term of this patent is extended or adjusted under 35 U.S.C. 154(b) by 831 days.

(21) Appl. No.: 10/948,473

(22) Filed: Sep. 23, 2004

(65) Prior Publication Data

US 2006/0061538 A1 Mar. 23, 2006

(51) Int. Cl.
*H05B 33/00* (2006.01)

(52) U.S. Cl. ..... 345/48; 345/60; 345/63; 345/77; 345/84; 313/501; 348/631; 382/162

(58) Field of Classification Search ..... 345/48, 345/60, 63, 77, 84; 313/496, 501, 506; 348/582, 348/631, 663; 382/162
See application file for complete search history.

(56) References Cited

U.S. PATENT DOCUMENTS 6,332,036 B1 * 12/2001 Sakamoto ..... 382/162
6,359,676 B1 * 3/2002 Treiber et al. ..... 355/46
6,384,529 B2 * 5/2002 Tang et al. ..... 313/506
6,693,611 B1 * 2/2004 Burroughes ..... 345/83
2001/0055082 A1 * 12/2001 Kubo et al. ..... 349/114
2002/0167262 A1 * 11/2002 Porter et al. ..... 313/483
2002/0190643 A1 * 12/2002 Cummings et al. ..... 313/553
2003/0103677 A1 * 6/2003 Tastl et al. ..... 382/240
2003/0184210 A1 * 10/2003 Russ ..... 313/461
2004/0169619 A1 * 9/2004 Hata et al. ..... 345/1.1
2004/0206307 A1 * 10/2004 Boroson et al. ..... 118/719
2004/0234166 A1 * 11/2004 Nakajima et al. ..... 382/302
2004/0263060 A1 * 12/2004 Gilmour et al. ..... 313/501

* cited by examiner

*Primary Examiner*—Bipin Shalwala
*Assistant Examiner*—Vince E Kovalick

(57) ABSTRACT

A method and system is provided for creating a display and generating images. Creating the display includes receiving a transmissive display component over an emissive display component and positioning each emissive display pixel with one or more transmissive display pixels creating a display surface capable of displaying color images. Displaying images on the display surface includes decomposing image data associated with the image into separate chrominance signal levels and luminance signal levels, displaying the representation of the chrominance signal levels of the image by driving emissive display pixels in correspondence to the chrominance characteristic of the image, generating the representation of the luminance signal levels for display through the emissive display pixels of the emissive display component and filtering the displayed representation of the luminance signal level using transmissive display pixels in accordance with the luminance characteristics of the image.

42 Claims, 6 Drawing Sheets

DISPLAY METHOD AND SYSTEM USING TRANSMISSIVE AND EMISSIVE COMPONENTS

BACKGROUND OF THE INVENTION

The present invention relates to display technology. Advances in display technology have led to the display of higher resolution images on many different screen sizes and in many different formats. These advances are not limited to applications using traditional cathode-ray tube (CRT) technology but also include projection displays, small near-to-eye (NTE) viewers in cameras and head mounted displays, consumer projector devices and even large digitally-based theatre projectors.

Some display applications utilize liquid crystal display (LCD) technology to display images. Three LCDs in an LCD projector individually modulate red, green and blue light respectively to form images on a projector screen or surface. Typically, the individual chromatic signals from the respective LCDs are combined within the projector device before being projected out to the screen. While the LCD projector tends to work well, it can be bulky and less portable due to this complex light-modulation mechanism within the projector.

Another technology used with displays referred to as a digital light processor (DLP) projection display uses Digital Micromirror Device (DMD) technology. The DLP projection display is often implemented using rear-projection screens or also in projector devices. The DMD portion is a semiconductor-based array of reflective mirrors that move quickly to modulate light. Lower cost DLP systems have a single DMD and a rotating color filter system in front of a light source synchronized to time-share working with the single DMD. These single DMD systems rely on the human visual system to integrate the three chromatic signals generated over a short time period into a crisp color image. Higher end and more expensive DLP systems are generally equipped with three DMDs to accommodate each of red, green, and blue colors to produce higher quality images. Overall, the DLP and DMD projection technology improves portability as the resulting equipment is often lighter and more compact. The light mechanism used to modulate the colors in DLP or DMD is not as bulky or complex compared with similar equipment used on the LCD based projectors.

Costs for the DLP and DMD technologies are quite high to most manufacturers. For at least these reasons, it would be useful to have an alternate technology for producing low-cost and high quality display devices.

BRIEF DESCRIPTION OF THE DRAWINGS

Features of the present invention and the manner of attaining them, and the invention itself, can be understood by reference to the following detailed description of embodiments of the invention, taken in conjunction with the accompanying drawings and schematics, wherein.

Like reference numbers and designations in the various drawings indicate like elements.

SUMMARY OF THE INVENTION

Figure 1:
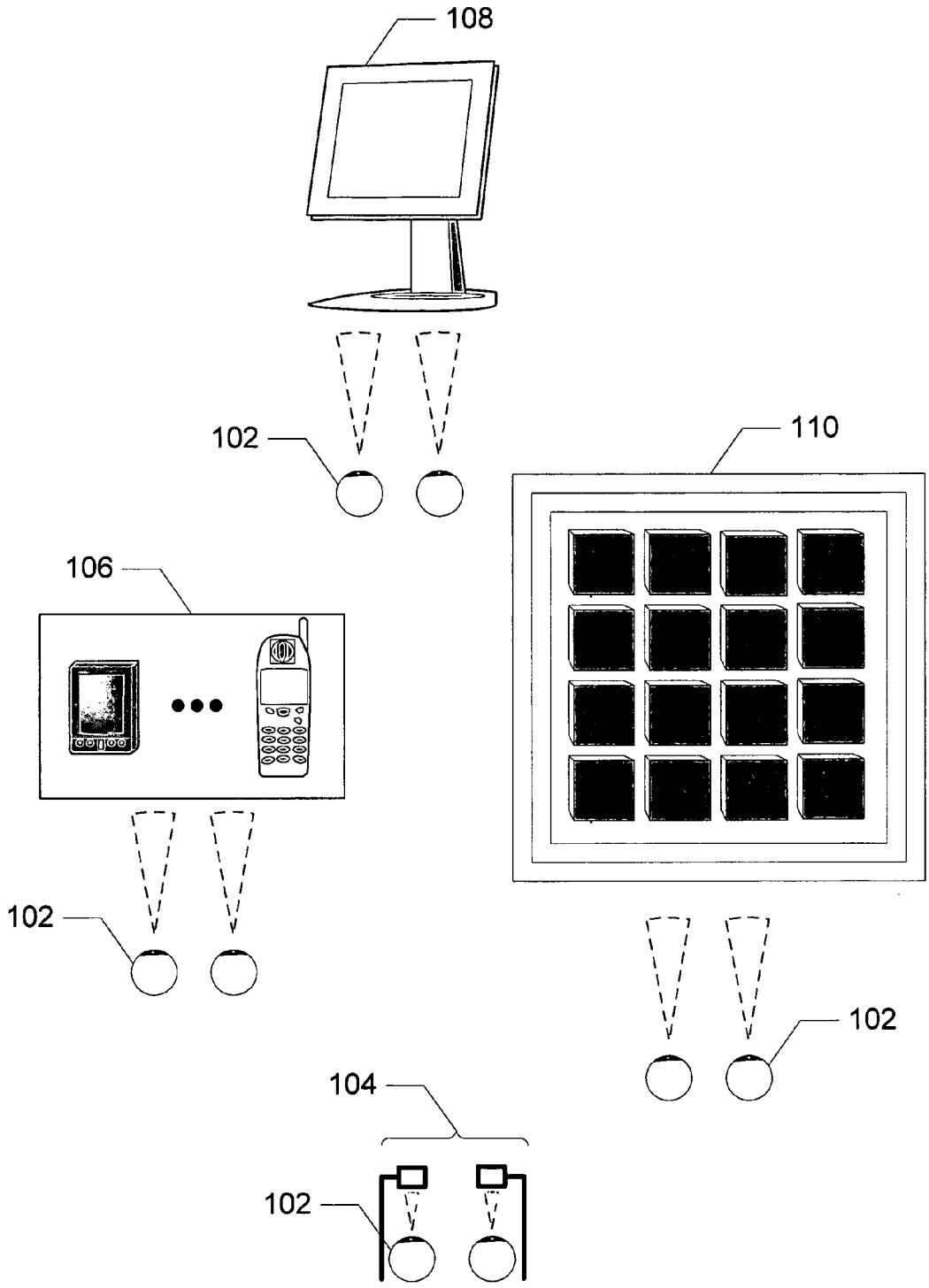
FIG. 1 is a diagram overview of systems and applications capable of using LC (luminance chrominance) displays created in accordance with the present invention.

One aspect of the present invention features a method and system for creating a display device. The display creation operation includes receiving a transmissive display component over an emissive display component, wherein the emissive display component has the same or fewer relative emissive display pixels compared with the transmissive display pixels in the transmissive display component and positioning each emissive display pixel with one or more transmissive display pixels creating a display surface capable of displaying color images.

Another aspect of the invention includes a method and system for displaying an image having chrominance and luminance characteristics on a surface. The display operations include decomposing image data associated with the image into separate chrominance signal levels and luminance signal levels, displaying the representation of the chrominance signal levels of the image by driving emissive display pixels in correspondence to the chrominance characteristic of the image, generating the representation of the luminance signal levels for display through the emissive display pixels of the emissive display component and filtering the displayed representation of the luminance signal level using transmissive display pixels in accordance with the luminance characteristics of the image.

DETAILED DESCRIPTION

Aspects of the present invention are advantageous in at least one or more of the following ways. The display device can be constructed from lower cost components yet maintain high-resolution display output. This allows higher resolution color displays to be manufactured economically. Accordingly, many more consumer devices and products can include and take advantage of having a high-resolution display device with the present invention.

Many different applications can use implementations of the present invention for meeting their display requirements. Smaller devices reduce the luminance and chrominance display portions of an image while large displays, projector televisions or digital cinema applications scale up the image for larger scale applications. In either case, both the smaller and larger implementations of the present invention will benefit from the lighter, more compact nature of the design along with lower costs associated with using readily available materials and multiple manufacturing sources.

Manufacturing implementations of the present invention are also advantageous as the underlying component technologies are already mass produced. For example, implementations of the present invention create a display device from a combination of OLED (organic liquid crystal display) and LCD (liquid crystal display) type material. Other designs consistent with the present invention may be implemented using light-emitting polymers as well as plasma and CRT to name a few other technologies. To meet demand, existing manufacturing lines and know-how can be utilized along with a few modifications to produce the necessary materials.

Displays of the present invention have a separate transmissive component and a emissive component that work together to generate a high-resolution output. The emissive display component has a lower resolution while the transmissive component operating at a higher resolution ensures the final image appears at a higher resolution. Image data processing takes advantage of the human visual systems reduced spatial acuity to variation in chrominance as compared to luminance. As the material used to emit the chrominance and luminance operates at a fraction of overall display resolution, it is also possible to manufacture the displays of the present invention at a lower cost compared with conventional display technology. Conventional displays continue to drive chrominance pixels at a much higher resolution than the human eye can perceive just to capture the human eyes sensitivity in the luminance layer. Implementations of the present invention obviate this latter requirement and avoid engineering the chrominance domain of displays beyond the visual acuity of the human visual system.

FIG. 1 is a diagram overview of systems and applications capable of using displays created in accordance with the present invention. In this example, eyes 102 are viewing a variety of microdisplays implemented in near-to-eye (NTE) viewers 104 and handheld devices 106 as well as television/computer size displays 108 and composite or large-scale displays 110. Each of these display genres can achieve high quality display output using aspects of the present invention and in accordance with the particular technical system needs. For example, NTE viewers 104 and handheld displays 106 can implement a luminance chrominance (LC) display of the present invention with the added requirement of operating with extra lower power and heat emission. Larger television/computer size displays 108 may not only have lower power and heat emission requirements but also even higher resolution or brightness requirements. Large-scale displays 110 used as billboards and/or in arenas may additionally have requirements to operate effectively in the outdoors over a wide range of temperatures and a wide range of viewing angles by eyes 102. It is contemplated that aspects of the present invention can be readily adapted to work within at least these various display genres and their operation requirements.

Figure 2A:
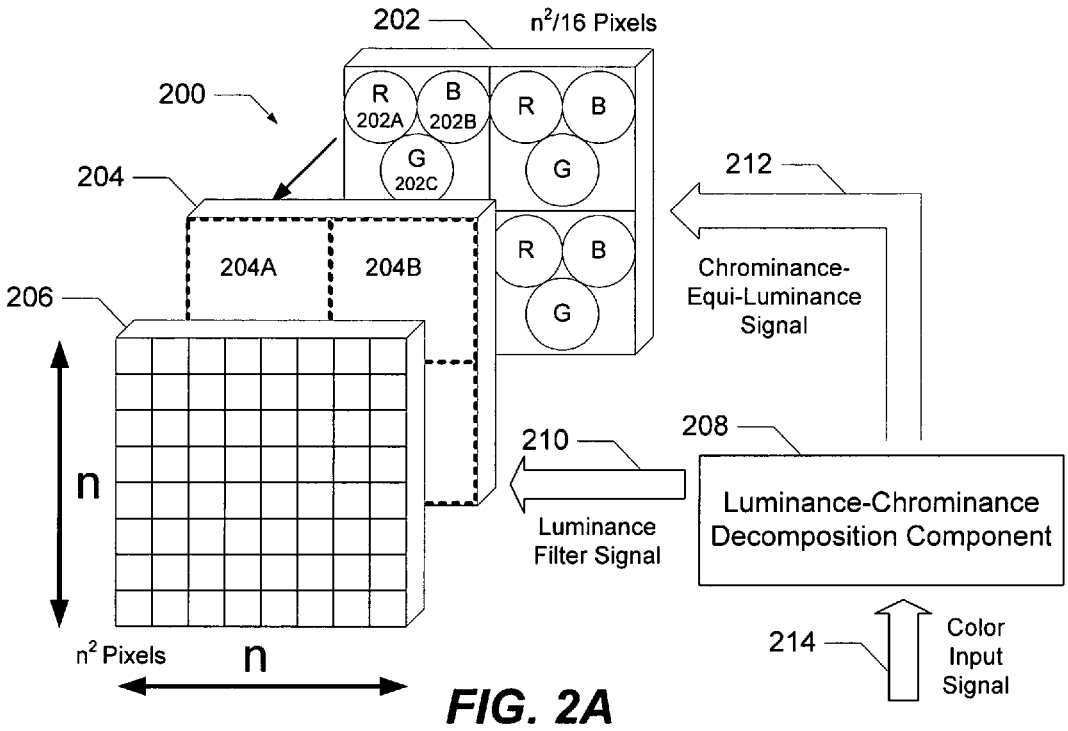
FIG. 2A, 2B and 2C are schematic diagrams illustrating the principals of LC display in accordance with different implementations of the present invention.
Figure 2B:
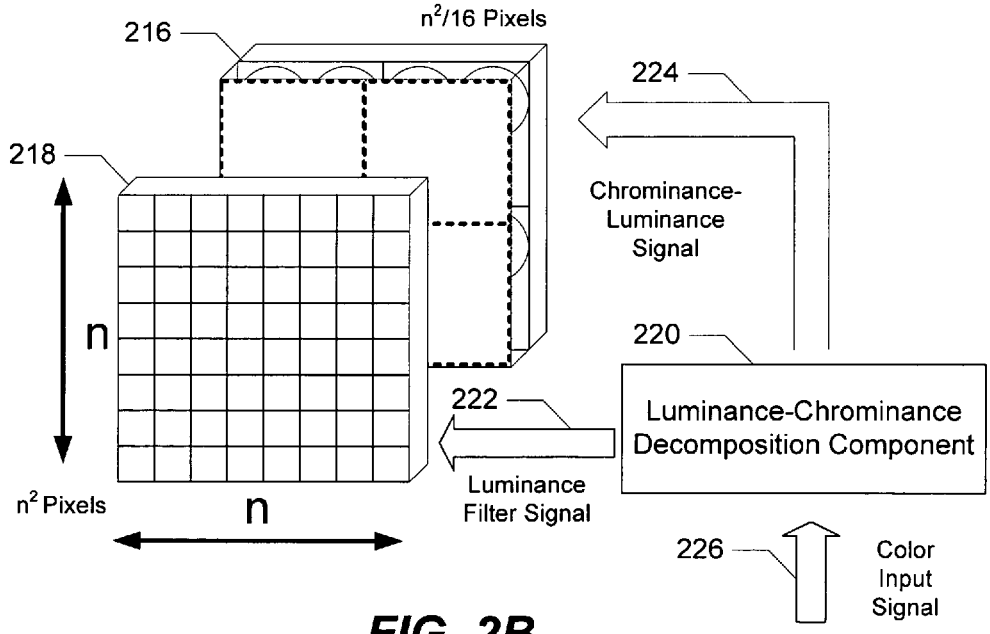
Figure 2C:
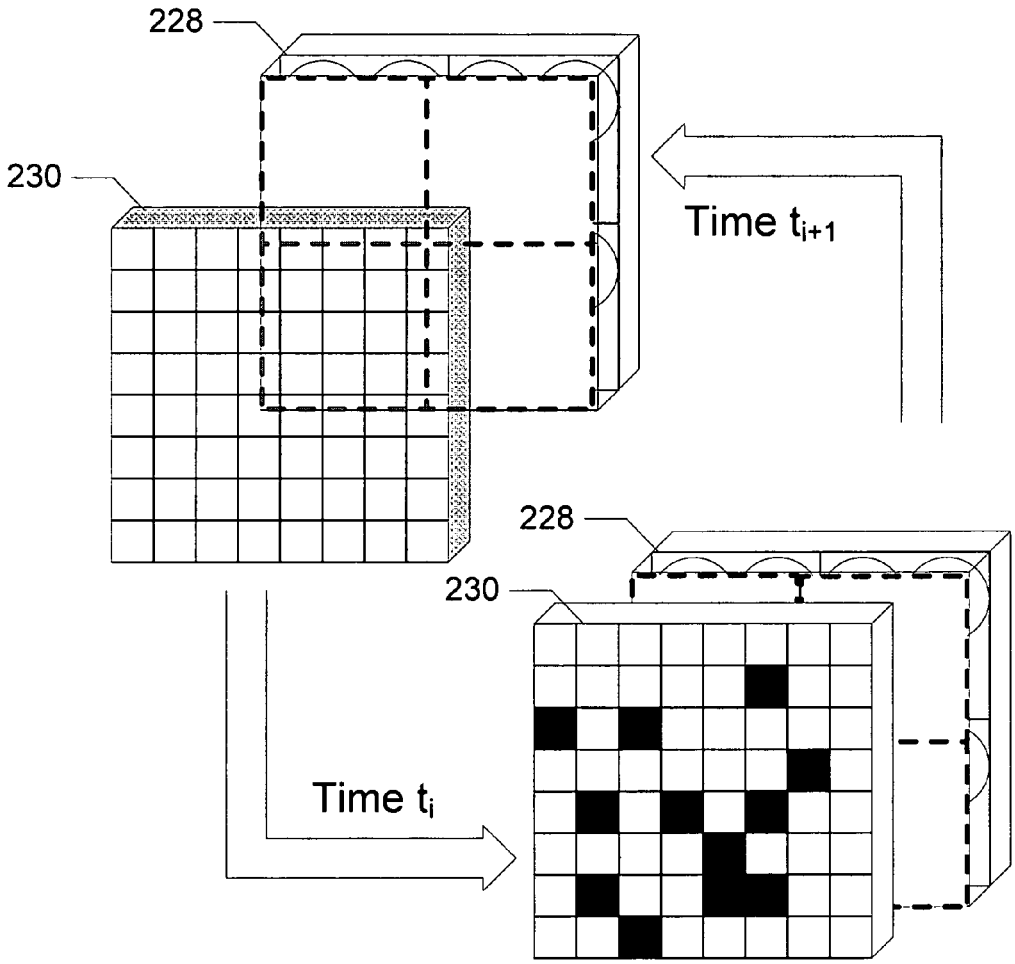

FIG. 2A, 2B and 2C are schematic diagrams, not drawn to scale, illustrating the principals of an LC display in accordance with different implementations of the present invention. Referring to FIG. 2A, an LC display schematic includes an emissive display component 202, a diffuser 204, a transmissive display component 206, a luminance chrominance decomposition component 208, a luminance filter signal 210, chrominance-equiluminance signal 212 and an color input signal 214. Emissive display component 202 includes a plurality of pixel locations each location including multiple subpixel components (e.g. red—202A, green—202B, blue—202C).

In the example implementation illustrated in FIG. 2A, diffuser 204 is positioned between emissive display component 202 and transmissive display component 206. Diffuser 204 combines the light emitted from the underlying subpixel components of red, green and blue after generation by emissive display component 202. Instead of passing individual light from subpixel components, the combined light passing through diffuser 204 appears uniform to transmissive layer 206. Under the control of chrominance equi-luminance signal 212, emissive display component 202 emits equal levels of luminance at each pixel location (i.e., equi-luminance) while also emitting the chrominance values corresponding to the color portion of the image. In certain cases, the equi-luminance requirement constrains the chrominance values causing colors to appear less saturated or vibrant.

Emissive display component 202 has fewer relative pixels compared with the number of pixels in transmissive display component 206. In one implementation, there are approximately $n^2$ transmissive display pixels for every $n^2/16$ emissive display pixels; representing the relative difference in spatial acuity perceived by the human visual system when viewing luminance versus chrominance respectively. This relative measure contemplates that each emissive display pixel includes a red, green and blue subpixel as compared with each of the display pixels in the overlying transmissive display component 206. Emissive display component 202 generates and passes red, green, and blue light while transmissive display component 206 filters the luminance light at a much higher resolution.

Further, it is also contemplated that implementations of the present invention could be applied to displays having various different aspect ratios other than the aspect ratios illustrated and described in FIG. 2A and hereinafter. For example, implementations of the present invention can be applied to displays having 1:1 aspect ratios and displays having n:m aspect ratios in which n is not equal to m. For example, one implementations of the present invention could utilize a 16:9 aspect ratio typically used in entertainment oriented display devices.

Diffuser 204 combines the different luminance contributions from the red, green and blue subpixels ensuring that transmissive display component 206 has an equiluminant signal to filter, as expected. Chrominance information from the red, green and blue subpixels is also combined by diffuser 204 during this process. With respect to luminance values, diffuser 204 is useful but not as critical or required under these conditions as the luminance level is equal or equiluminant in the display. As previously described, the luminance level emitted from emissive display component 202 in this implementation is the same from each set of three subpixels.

In equiluminant operation, luminance levels emitted from one emissive display pixel on emissive display component 202 can "bleed" over through one section 204A of diffuser 204 to adjacent section 204B of diffuser 204 without significant impact to forming the final image. For example, this might occur in the event diffuser 204 is not precisely aligned along the sub-pixel box boundaries of the underlying emissive display component 202. It also may occur due to some gap or distance between diffuser 204 and either emissive display component 202 or transmissive display component 206. Consequently, using the equiluminant signal simplifies processing and alignment requirements as the same luminance signal effectively reaches transmissive display component 206.

In operation, luminance chrominance decomposition component 208 processes RGB, sRGB or other color input signal 214 and provides luminance filter signal 210 (also referred to as luminance signal) and chrominance-equi-luminance signal 212 (also referred to as chrominance signal) to transmissive display component 206 and emissive display component 202 respectively. In response, emissive display component 202 controls the various emissive display pixels to output light from each of the subpixel components corresponding to the chrominance values of the image reproduced from the RGB or other colorspace data. Although emissive display component 202 operates at a lower resolution, the resolution for displaying chrominance is sufficient for the demands imposed by the human visual system's sensitivity.

In addition to displaying chrominance, emissive display component 202 also emits equiluminance at a lower resolution. Diffuser 204 combines the chrominance and luminance signal traveling between transmissive display component 206 and emissive display component 202 as previously described. To increase the effective resolution, luminance filter signal 210 causes the higher resolution transmissive display component 206 to filter the received equiluminance according to the actual image from color input stream 214. The resulting combination of chrominance and luminance produces a color image perceived by the human visual system to have the higher resolution of the transmissive display component 206 despite being derived, in part, from the lower resolution of the underlying emissive display component 202.

In the previously described equiluminant implementation, the luminance of the LC display depends on the equiluminant signal level being emitted by emissive display component 202. In one implementation, the luminance signal level emitted from the emissive display component 202 is set according to the color gamut characteristic and the desired color saturation associated with emissive display component 202. For example, a maximum saturation level can produce more vibrant colors yet dictates a lower luminance level from the LC display of the present invention. Conversely, higher luminance levels typically result in lower saturation and less vibrant colors from the LC display.

Alternatively, the luminance signal level emitted by emissive display component 202 is not fixed and equiluminant but varies depending on the gamut encompassed by the images or sequence of images in a video stream. For example, an image requiring vibrant colors can be set to have a high saturation and lower luminance while an image with less vibrant colors can be brighter by setting the luminance level higher and saturation level lower.

FIG. 2B illustrates an alternate implementation of the present invention utilizing a chrominance-luminance signal producing various levels of luminance. This implementation of the present invention includes a diffused emissive display component 216 and a transmissive display component 218 capable of filtering different levels of luminance produced by the underlying emissive layer. A luminance chrominance decomposition component 220 also receives a color input signal 226 yet does not convert to an equiluminant representation as previously described. Instead, luminance chrominance decomposition component 220 generates a chrominance-luminance signal 224 to drive diffused emissive display component 216 and a luminance filter signal 222 that drives transmissive display component 218.

Each of the $n^2/16$ pixels in emissive display component 202 generates a desired chrominance and a luminance level equal to the maximum luminance from a corresponding pixel group in the image, rather than an equi-luminant level as previously described. The pixel group is a selected number of pixels from the image data used in calculating the maximum luminance level. In this implementation, the diffuser portion is integrated and precisely aligned over the emissive display portion as different luminance levels would otherwise 'bleed' over from one of the adjacent pixels and would impact the quality of the image. For similar reasons, transmissive display component 218 is also precisely aligned over the diffuser portion to prevent 'bleed' over from the different luminance levels of the adjacent pixels.

In this alternate implementation illustrated in FIG. 2B, chrominance-luminance signal 224 averages the chromaticity of each pixel group and sets the luminosity level to the maximum luminance level associated with one individual pixel in the corresponding group of pixels in the image. For reasons previously described, this initially creates a lower-definition image commensurate with the resolution of diffused emissive display component 216.

Luminance filter signal 222 causes transmissive display component 218 to filter luminance levels initially set to the various maximum luminance levels. Individual pixels in transmissive display component 218 process different luminance levels rather than a single equiluminant level previously described in the latter embodiment. For example, transmissive display component 218 filters a higher luminance value from one pixel of diffused emissive display component 216 differently from another pixel emitted with a lower luminance value. Passing the lower-definition image through higher-resolution transmissive display component 218 causes the maximum luminance levels to be reduced to their desired values. These operations effectively create the appearance of a much higher resolution image.

Emissive display component 202 or diffused emissive display component 216 can be implemented using organic light-emitting diode (OLED) technology as it operates at lower power with less heat emission, liquid crystal on silicon (LCOS) as well as any other luminance chrominance display technology suitable for use with aspects of the present invention. Other technologies that could be used for the emissive display component include: light-emitting polymers, plasma and cathode-ray tube (CRT) display technologies.

Additionally, transmissive display component 206 or transmissive display component 218 can be implemented using liquid crystal display (LCD) or many other different technologies. The decision to implement one technology over another is primarily a design decision and depends on the relative costs and resolutions desired. These factors may include the capabilities of an emissive display component to generate lower resolution chrominance and luminance light and the transmissive display component to transmit or pass chrominance light while filtering the luminance component at a relatively higher resolution.

Further, emissive display component 202 or diffused emissive display component 216 and transmissive display component 206 or transmissive display component 218 can be implemented with monolithic technologies rather than separate discrete layers or technologies. For example, it is contemplated that the emissive layer can be implemented using "backlit" transmissive display technology like an LCD. Optionally, the backlit transmissive display can sequentially emit red, green and blue within the flicker-fusion threshold frequency and illuminate another transmissive layer used to filter the emitted light. In either case, the transmissive layer then filters the luminance portion of the signal as previously described to effectuate a quality color image using lower resolution chrominance and higher resolution luminance display technologies.

It is also contemplated that displays in accordance with the present invention can be subsampled by different amounts other than the 4×4 or factor of 16 as previously described. Instead, the emissive component could be subsampled by different amounts depending on the resolution of the transmissive component and the viewing distance between the display and an audience or user. For example, the subsampling factor between the emissive resolution and transmissive resolution respectively could be described as $n^2/x^2$, where x can be any integer greater than 1. It also follows that the subpixels in an RGB technology would be subsampled according to $3n^2/x^2$.

Consequently, while describing a subsampling ratio of $n^2/16$ for convenience, it is understood that this is only an example and many other subsampling ratios and approaches could be taken in accordance with implementations of the present invention. As it is contemplated, implementations of the present invention could have various different aspect ratios, the subsampling factor could occur over areas having aspect ratios other than 1:1 and also include sample areas of n:m wherein n is not equal to m.

FIG. 2C illustrates yet another implementation of the present invention that alternates between displaying chrominance and luminance. In this implementation, a diffused emissive display component 228 generates the chrominance portion of the image at time $t_i$ and then at a subsequent time $t_{i+1}$ generates a pure "white light" (i.e., maximum luminance) for the luminance portion of the image in accordance with implementations of the present invention. For example, at time t transmissive display component 230 operates in a maximum transmissive mode allowing diffused emissive display component 228 to pass the chrominance with little interference. Subsequently, at time $t_{i+1}$ transmissive display component 230 processes the bright white luminance signal by filtering. By reducing the time interval sufficiently, the human visual system integrates the signals and creates a high resolution color image in accordance with implementations of the present invention.

Figure 2D:
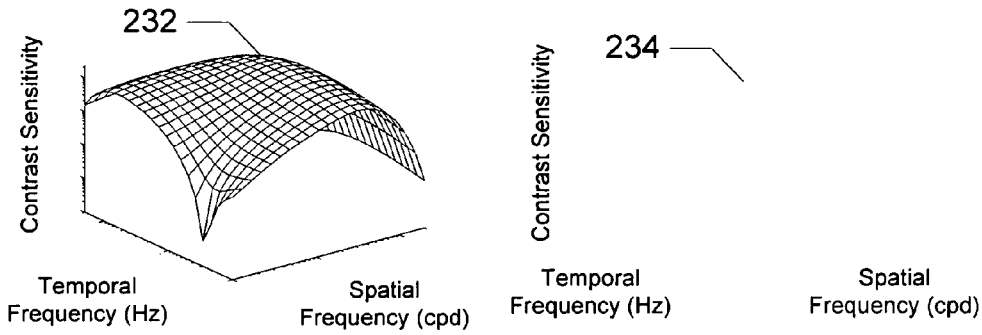
FIG. 2D depicts relative differences in the human visual system using a luminance sensitivity graph and a chrominance sensitivity graph in accordance with one implementation of the present invention.

Tests involving operation of the human visual system confirms the effectiveness of a display designed in accordance with the present invention. In FIG. 2D, the comparison between luminance sensitivity graph 232 and chrominance sensitivity graph 234 depicts the relative sensitivities in the human visual system exploited by implementations of the present invention. For example, these graphs show the human visual system has approximately ¼ the linear acuity for chrominance when compared with luminance. Consequently, implementations of the present invention need only represent the chrominance portion of an image area at approximately 1/16 the resolution of the luminance component to maintain the appearance of having the higher resolution displayed through the luminance component alone.

Figure 3:
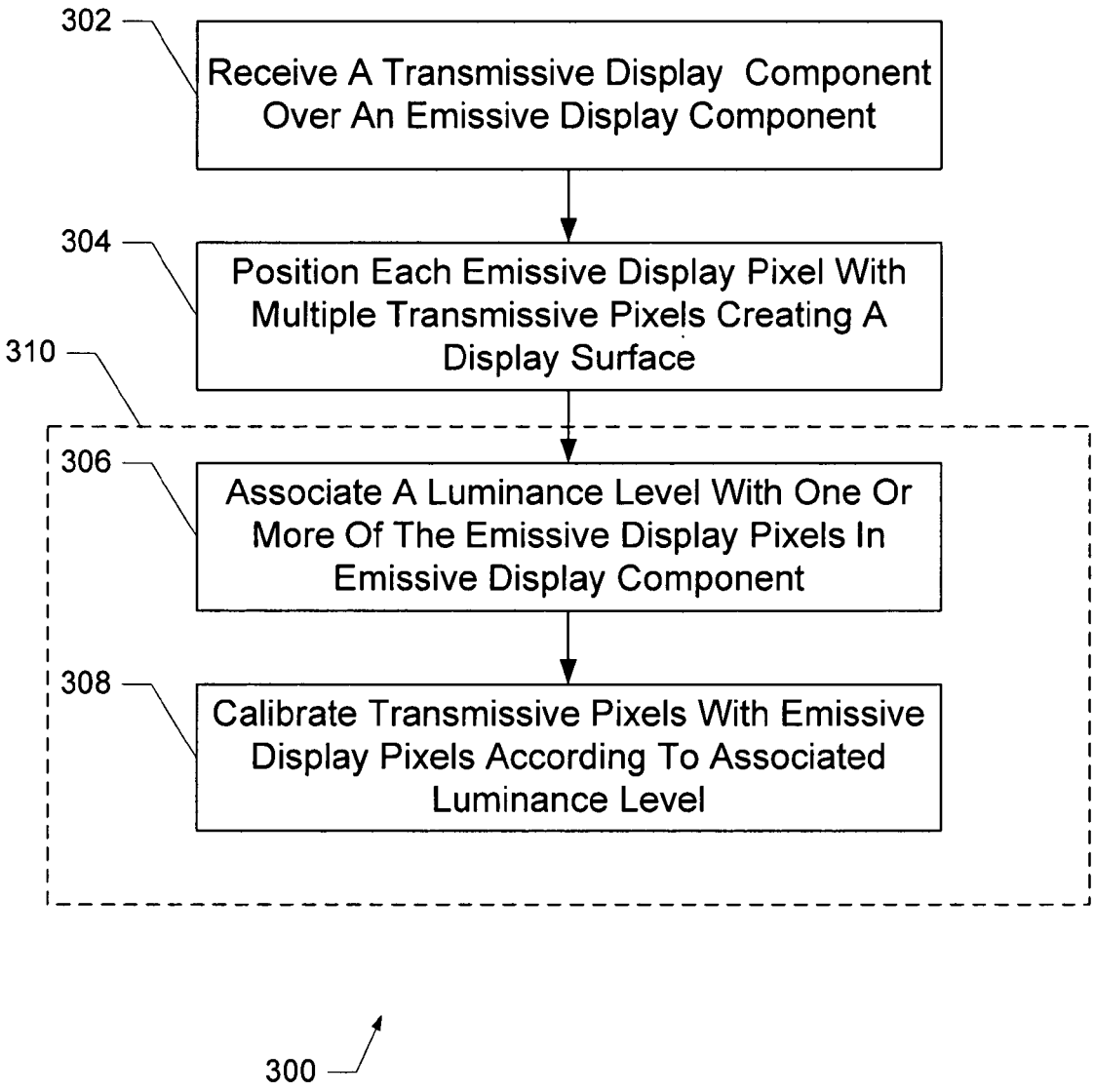
FIG. 3 is a flowchart diagram of the operations for creating an LC display device in accordance with one implementation of the present invention.

FIG. 3 is a flowchart diagram of the operations for creating an LC display device in accordance with one implementation of the present invention. These block diagrams describe one process for both manufacturing and, optionally, calibrating an LC display device in accordance with the present invention. Initially, the manufacturing process receives and places the transmissive display component over an emissive display component having the same or fewer relative pixels (302). In one example, a transmissive display component has $n^2$ transmissive display pixels for each $n^2/16$ emissive display pixel of the emissive display component. As previously described, alternate implementations may use different subsampling factors between the emissive resolution and transmissive resolution respectively as long as $n^2/x^2$, where x can be any integer greater than 1. A diffuser can be integrated onto the surface of the emissive display component as previously described or can be placed therebetween the emissive display component and the transmissive display component.

An alignment operation positions each emissive display pixel with multiple transmissive pixels creating the LC display device (304). Based on the human visual system, one optimal arrangement would use a minimum of $n^2/16$ emissive display pixels for each $n^2$ transmissive display pixels to achieve a cost effective construction. Increasing the number of emissive display pixels beyond $n^2/16$ may be done for manufacturing convenience or for implementations where the viewing distance is very short, but would generally not increase the perceived resolution of the images produced.

To optionally calibrate the LC display device as indicated by dashed enclosing box 310, the manufacturing operation associates a luminance level with one or more of the emissive display pixels in the emissive display component (306). This operation involves testing and identifying the actual luminance level produced each of the emissive display pixels. Small variations in the luminance levels produced can be later used to coordinate and calibrate the operation between the emissive display component and the transmissive display component. The associated calibration can dynamically account for non-uniform display characteristics present in the individual emissive display component and transmissive display component due to manufacturing variances.

As another option also indicated by dashed enclosing box 310, a luminance level measured during manufacture can later be used to calibrate the transmissive pixels with emissive display pixels (308) as described. This calibration can take place immediately during manufacture as a permanent adjustment of the hardware associated with the transmissive pixels or accounted for later by storing a calibration vector in a non-volatile memory storage associated with the LC display device. Drivers and other software using the LC display device of the present invention may optionally use this calibration vector of individual pixel luminance levels to fine-tune operation of the LC display device and better reproduce the luminance portion of the image at higher resolutions.

Figure 4:
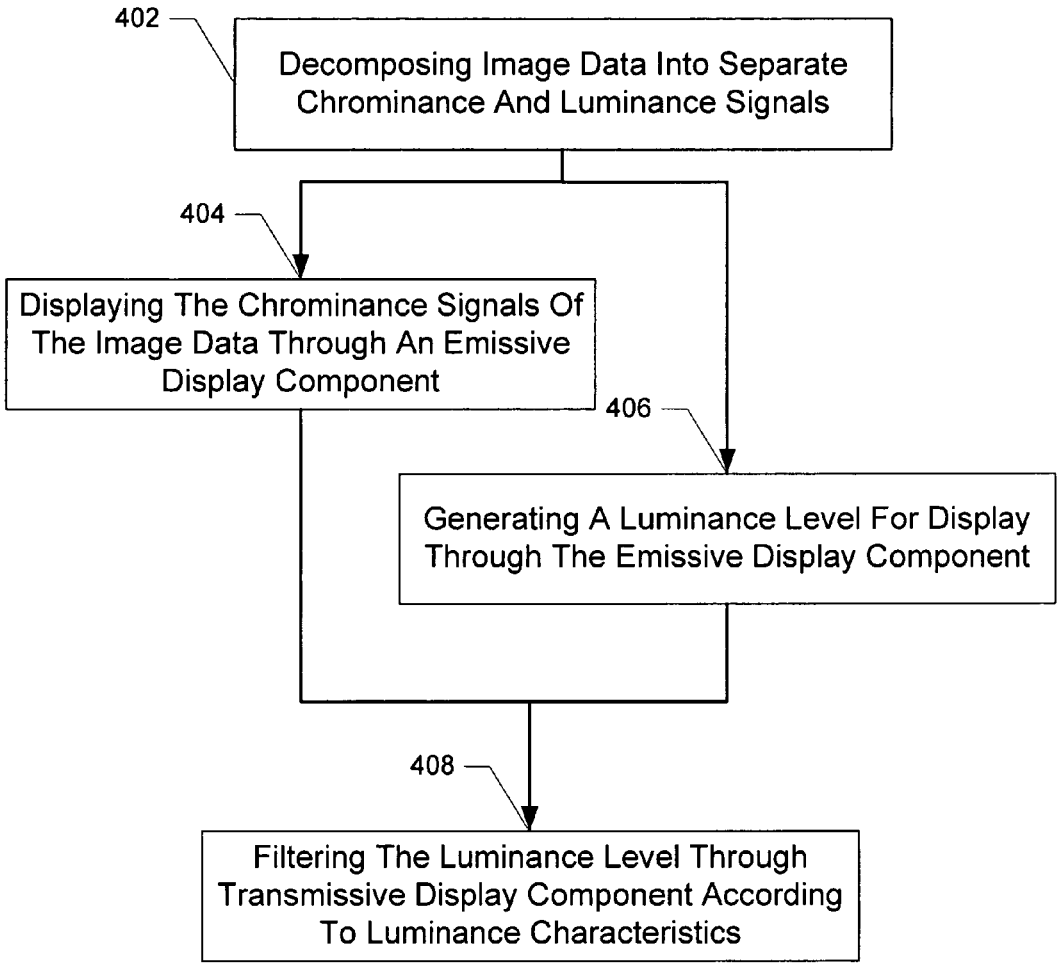
FIG. 4 is a flowchart diagram of the operations for displaying an image with chrominance and luminance characteristics on a LC display designed in accordance with the present invention.

FIG. 4 is a flowchart diagram of the operations for displaying an image with chrominance and luminance characteristics on an LC display device designed in accordance with the present invention. Color images having both chrominance and luminance characteristics are typically described in a particular color space and targeted at a standard gamut or gamut associated with a particular device. For a more general application, the color images can be represented in sRGB color space and later gamut mapped to the particular gamut of the display device being driven. It is contemplated, for example, that luminance chrominance decomposition component 208 or 220 in FIG. 2A and 2B respectively would perform this gamut mapping along with decomposition operations and many other types of image processing routines. Images can also be represented and processed by implementations of the present invention using other color spaces including CIELAB.

Implementations of the present invention operate in chrominance and luminance and can be represented in one or more opponent color representations that include a luminance and chrominance representation. These opponent color representations may include YCC, YCrCb, CIELAB, LUV, YIQ, and others. Accordingly, opponent color representation described herein uses "Y" for luminance and "C1" and "C2" for the two chrominance channels but is compatible with any opponent color representation including those previously described as well as any other opponent color representation currently used or subsequently developed and/or discovered representing chrominance with two or more channels.

One implementation of the present invention decomposes the image data from the conventional color space into separate chrominance and luminance signals for the display device (402) As previously illustrated and described in conjunction with FIG. 2A and 2B, luminance chrominance decomposition component 208 can be used to separate the chrominance and luminance signals as well as gamut mapping and many other image processing operations. For example, decomposition and separation operations further involves applying a color rendering transform or colorimetric mapping to adjust to the display device gamut. To simplify the subsequent processing, the gamut mapped image information for the device is then analyzed and converted to an opponent color representation of YC1C2. For example, the image could be mapped into a luminance and chrominance representation in intensity-chromaticity color spaces of YUV or YIQ.

Using the YC1C2 notation, the image would remain at the higher resolution of the initial image transmitted in sRGB or RGB colorspace. Accordingly, the chrominance portion represented by C1, C2 is then down-sampled to match the lower resolution of the emissive display component. In one implementation, the mean chrominance values $C1_{mean}$, $C2_{mean}$ obtained from each $n^2/16$ emissive pixel values is used to drive the lower resolution emissive display component. Alternate implementations of the present invention may use a different average or other calculation other than the 'mean' calculation as previously described to facilitate down-sampling the C1, C2 chrominance representation.

A different calculus applies to the luminance to be emitted from the $n^2/16$ emissive pixels as the luminance portion needs to effectively retain the higher resolution. For example, a maximum luminance value $Y_{max}$ is measured from the image portion corresponding to a 16 pixel area in the transmissive display component yet corresponds to 1 emissive pixel in the emissive display component. The maximum luminance level or $Y_{max}$ is selected as the luminance level to be emitted from the emissive display pixel. By selecting the maximum luminance value $Y_{max}$, the transmissive display component has the ability to subsequently filter areas of luminance at a higher resolution and effectively restore the overall perceived higher resolution of the image. Displaying luminance from the emissive display component at a value greater than $Y_{max}$ does not necessarily increase resolution or improve luminance as it would exceed any luminance level in the pixel area of the image.

Displays operating the emissive display component in an equiluminant mode provide an equiluminant level $Y_{equi}$ that is the same for each pixel in the emissive display component. As previously described, one implementation of the present invention sets $Y_{equi}$ according to the desired color saturation of the LC display. For example, if a saturated blue is to be displayed then $Y_{equi}$ is set to the luminance of the blue primary on the display, which usually has the lowest luminance of the red, green, and blue primaries. Using a higher luminance for $Y_{equi}$ improves the overall luminance of the LC display but reduces the color saturation displayed on the LC display.

The resulting YC1C2 values processed for use by the LC display device (hereinafter $YC1C2_{L-C}$) are used to display the chrominance signals of the image data through an emissive display component (404). In one implementation, the $YC1C2_{L-C}$ values are converted to red (R), green (G) and blue (B) levels to drive the red, green and blue subpixels of the emissive display component of the present invention and as a practical matter of operating an RGB based display device. The RGB subpixels drive the display of chrominance and luminance signal levels associated with the emissive display component. In one implementation, the RGB levels drive the display to provide chrominance levels corresponding to $C1_{mean}$ and $C2_{mean}$ and luminance level $Y_{max}$ as previously described. In another implementation, the RGB subpixels drive the display to provide chrominance levels corresponding to $C1_{mean}$ and $C2_{mean}$ and luminance level $Y_{equi}$, also as previously described.

The emissive display component also generates a luminance level for display through the emissive display component (406). As previously described, the luminance levels could be displayed at the same time as the chrominance levels or could be shifted temporally and displayed subsequent or previous to the chrominance levels. For example, the luminance levels could be alternatively displayed over time with the desired chrominance levels. Temporally separating the display of luminance information from the chrominance information improves overall image quality and at the same time makes more efficient use of the display technology of the present invention.

Each of the transmissive display pixels filters the luminance level received by transmissive display component according to the particular luminance characteristics of the image at the higher resolution (408). In one implementation, this amounts to filtering and/or darkening one or more of the transmissive display pixels to restore the resolution of the luminance layer lost when down-sampling the chrominance layer. Fortunately, this information is preserved and transmitted through a luminance-filter signal processed specifically to control this filtering process.

Higher luminance signal levels are also possible as an alternate implementation of the present invention could operate a greater number of blue subpixel primaries compared with red or green subpixel primaries in the emissive display component. For example, using 2 blue subpixels, 1 red subpixel and 1 green subpixel (RG2B) would increase the subpixel count to $4n^2/x^2$ rather than $3n^2/x^2$ where $n^2$ is the area of the corresponding transmissive display pixel and x is a resolution factor greater than 1 set according to the emissive display component resolution.

Figure 5:
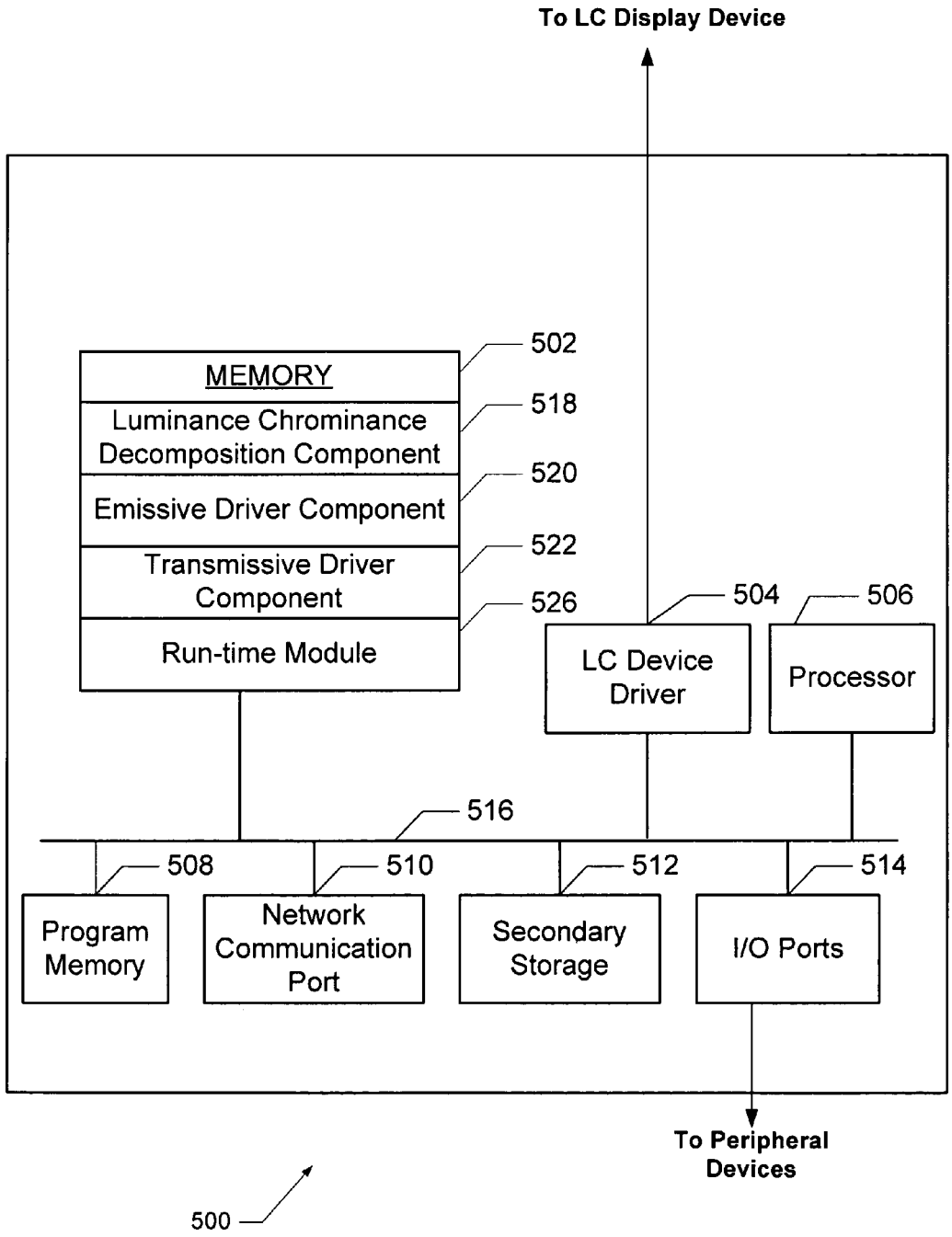
FIG. 5 is a diagram of a system designed in accordance with implementations of the present invention.

FIG. 5 is a block diagram of a system 500 designed in accordance with one implementation the present invention. System 500 includes a memory 502 to hold executing programs (typically random access memory (RAM) or read-only memory (ROM) such as a flash RAM), an L-C display driver 504 capable of interfacing and driving an LC display device or output device of the present invention, a processor 506, a program memory 508 for holding drivers or other frequently used programs, a network communication port 510 for data communication, a secondary storage 512 with secondary storage controller, and input/output (I/O) ports 514 also with I/O controller operatively coupled together over a interconnect 516. System 500 can be preprogrammed, in ROM, for example, using field-programmable gate array (FPGA) technology or it can be programmed (and reprogrammed) by loading a program from another source (for example, from a floppy disk, a CD-ROM, or another computer). Also, system 500 can be implemented using customized application specific integrated circuits (ASICs).

In one implementation, memory 502 includes a luminance chrominance decomposition component 518, an emissive driver component 520, a transmissive driver component 522 and a run-time module 526 that manages system resources used when processing one or more of the above components on system.

Luminance chrominance decomposition component 518 decomposes images into various color representations including RGB, YCC, YCrCb, CIELAB, YUV, LUV, YIQ, HIS, $Y_{max}$, $U_{mean}$, $V_{mean}$, YC1C2, $YC1C2_{L-C}$ and performs other color space transformations in accordance with the present invention and as previously described. In operation, emissive driver component 520 receives the decomposed information in YC1C2 or RGB and drives the emissive component as previously described. Transmissive driver component 522 causes the transmissive display component to filter the luminance information and generate the appearance of a higher resolution color image. The LC display of the present invention consists of both the emissive display component and the transmissive display component. These components operate together to create a self-luminous high resolution display device operating at the resolution of the transmissive component rather than a lower resolution of the emissive component.

While examples and implementations have been described, they should not serve to limit any aspect of the present invention. Accordingly, implementations of the invention can be implemented in digital electronic circuitry, or in computer hardware, firmware, software, or in combinations of them. Apparatus of the invention can be implemented in a computer program product tangibly embodied in a machine-readable storage device for execution by a programmable processor; and method steps of the invention can be performed by a programmable processor executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs.

While specific embodiments have been described herein for purposes of illustration, various modifications may be made without departing from the spirit and scope of the invention. For example, the LC display is described as having approximately $n^2$ transmissive display pixels for every $n^2/16$ emissive display pixels however the display pixels could cover an area of n×m, where n does not equal m, and have a variety of aspect ratios other than 1:1. Further, the ratio of 1:16 emissive display pixels compared transmissive display pixels is only one ratio and many others can be used in accordance with implementations of the present invention. Accordingly, the invention is not limited to the above-described implementations, but instead is defined by the appended claims in light of their full scope of equivalents.

What is claimed is:

1. A method of creating a display device, comprising:

receiving a transmissive display component having transmissive display pixels over an emissive display component, wherein the emissive display component has the same or fewer relative emissive display pixels compared with the transmissive display pixels in the transmissive display component;

positioning each emissive display pixel with one or more transmissive display pixels creating a display surface capable of displaying color images;

associating a luminance signal level with each of the emissive display pixels in the emissive display component; and calibrating the transmissive display pixels with a respective emissive display pixel according to the luminance signal level associated with each emissive display pixel.

2. The method of claim 1 wherein the luminance signal level associated with the emissive display pixel is entered into a vector for subsequent calibration operations.

3. The method of claim 1 wherein the transmissive display component is constructed from a liquid crystal display (LCD) material.

4. The method of claim 1 wherein the transmissive display component is capable of selectively removing a portion of a luminance signal level emitted from the emissive display component in accordance with a luminance value associated with an image to be displayed on the display surface.

5. The method of claim 1 wherein the emissive display component is constructed from a set of materials including: organic light emitting diode (OLED) material, light-emitting polymers, plasma, CRT, and back-lit LCD.

6. The method of claim 1 wherein the emissive display component is self-luminous and capable of emitting a chrominance signal level along with a luminance signal level according to an image to be displayed on the surface.

7. The method of claim 1 wherein the emissive display component and transmissive display component are implemented using an integrated display having backlit capabilities.

8. The method of claim 1 wherein each emissive display pixel in the emissive display component includes red, blue and green subpixel primaries.

9. The method of claim 1 wherein the emissive display component includes more blue subpixel primaries compared with red and green subpixel primaries for increased luminance.

10. The method of claim 1 wherein the luminance signal level to be emitted by the emissive display component is set based upon the desired color saturation of the display.

11. The method of claim 1 wherein the luminance signal level to be emitted by the emissive display component is set based upon the color gamut of the display.

12. The method of claim 1 wherein the luminance signal level to be emitted by the emissive display component is set based upon the color gamut of an image.

13. The method of claim 1 wherein the luminance signal level for one emissive pixel in the emissive display component is set based upon the highest luminance value in a corresponding set of pixels from an image.

14. A method of displaying an image having chrominance and luminance characteristics on a surface comprising:

decomposing image data associated with the image into separate chrominance signal levels and luminance signal levels;

displaying the representation of the chrominance signal levels of the image by driving emissive display pixels in correspondence to the chrominance characteristic of the image;

generating the representation of the luminance signal levels for display through the emissive display pixels of the emissive display component; and filtering the displayed representation of the luminance signal level using transmissive display pixels in accordance with the luminance characteristics of the image.

15. The method of claim 14 wherein the image is selected from a set of media including still images, video images, graphics and text.

16. The method of claim 14 wherein the emissive display pixels are part of an emissive display component.

17. The method of claim 16 wherein the emissive display component is implemented using one of the materials selected from a set of materials including: organic light emitting diode (OLED) material, light-emitting polymers, plasma, CRT, and backlit LCD.

18. The method of claim 17 wherein the emissive display component includes red, blue and green subpixel primaries.

19. The method of claim 16 wherein the emissive display component is self-luminous and capable of emitting the representation of the chrominance signal according to the chrominance characteristics of the image to be displayed on the surface.

20. The method of claim 16 wherein the emissive display component of the surface generates the representation of the luminance signal level and that a transmissive display component selectively removes a portion of the representation of the luminance signal level according to the luminance characteristics of the image.

21. The method of claim 14 wherein the transmissive display pixels are part of a transmissive display component.

22. The method of claim 21 wherein the luminance signal levels driving the transmissive display component are constructed from a liquid crystal display (LCD) material.

23. The method of claim 14 wherein the emissive display pixels are driven to display the chrominance characteristics at a first time interval and driven to display the luminance characteristics at a second time interval.

24. The method of claim 14 wherein a chrominance resolution carried by the chrominance signal level is down-sampled to match a lower resolution of the emissive display pixels compared with the pixels associated with the transmissive display component.

25. The method of claim 24 wherein the down-sampled chrominance resolution corresponds to an average value calculated from a set of chrominance values in the image.

26. The method of claim 14 wherein each emissive display pixel in the emissive display component includes red, blue and green subpixel primaries.

27. The method of claim 14 wherein each emissive display pixel uses the same luminance signal level throughout the display surface.

28. The method of claim 14 wherein each emissive display pixel uses a maximum luminance value obtained from a set of luminance values associated with the image.

29. The method of claim 14 wherein the representation of the luminance signal level generated by each emissive display pixel is increased by driving more blue subpixel primaries compared with red and green subpixel primaries in each emissive display pixel.

30. The method of claim 14 wherein the luminance signal level driving the emissive display pixel is set to a luminance value based upon the desired color saturation of the surface.

31. The method of claim 14 wherein the luminance signal level driving the emissive pixels is set to the highest luminance value for a set of transmissive pixels associated with the image.

32. A display device for displaying an image, comprising:

an emissive display component capable of representing a luminance signal level and a chrominance signal level corresponding to the luminance characteristics and chrominance characteristics in the image; and a transmissive display component positioned over the emissive display component, said transmissive display component having transmissive display pixels capable of filtering the representation of a luminance signal level according to the luminance characteristics in the image.

33. The apparatus of claim 32 wherein the emissive display component has the same or fewer emissive display pixels compared with the number of transmissive display pixels in the transmissive display component.

34. The apparatus of claim 32 wherein the transmissive display component uses a liquid crystal display (LCD) material.

35. The apparatus of claim 32 wherein the transmissive display component is capable of selectively removing a portion of the luminance signal level emitted from the emissive display component in accordance to the luminance characteristics associated with an image.

36. The apparatus of claim 32 wherein the display surface can be arranged according to one or more different aspect ratios.

37. The apparatus of claim 32 wherein the emissive display component uses a display material selected from a set including: organic light emitting diode (OLED) material, light-emitting polymers, plasma, CRT, and backlit LCD.

38. The apparatus of claim 32 wherein a chrominance resolution carried by the chrominance signal level is down-sampled to match a lower resolution of pixels in the emissive display component compared with the pixels associated with the transmissive display component.

39. The apparatus of claim 38 wherein the down-sampled chrominance resolution corresponds to an average value calculated from a set of chrominance value levels in the image.

40. An apparatus for creating a display device, comprising:

means for receiving a transmissive display component having transmissive display pixels over an emissive display component, wherein the emissive display component has the same or fewer emissive display pixels compared with the transmissive display pixels in the transmissive display component, wherein each of the emissive display pixels is associated with a luminance signal level, and wherein each of the transmissive display pixels is calibrated with a luminance signal level of a respective emissive display pixel; and means for positioning each emissive display pixel with one or more transmissive display pixels creating a display surface capable of displaying color images.

41. An apparatus for displaying an image having chrominance and luminance characteristics on a surface comprising:

means for decomposing image data associated with the image into separate chrominance signal levels and luminance signal levels;

means for displaying the representation of the chrominance signal levels of the image by driving emissive display pixels in correspondence to the chrominance characteristic of the image;

means for generating the representation of the luminance signal levels for display through the emissive display pixels of the emissive display component; and means for filtering the displayed representation of the luminance signal level using transmissive display pixels and in accordance with the luminance characteristics of the image.

42. A computer readable storage medium on which is embedded one or more computer programs, said one or more computer programs implementing a method for displaying an image having chrominance and luminance characteristics on a surface, said one or more computer programs comprising instructions operable to cause a programmable processor to:

decompose image data associated with the image into separate chrominance signal levels and luminance signal levels;

display the representation of the chrominance signal levels of the image by driving emissive display pixels in correspondence to the chrominance characteristic of the image;

generate the representation of the luminance signal levels for display through the emissive display pixels of the emissive display component; and filter the displayed representation of the luminance signal level using transmissive display pixels and in accordance with the luminance characteristics of the image.

* * * * *